United States Patent [19]

Schampers et al.

[11] 4,025,814

[45] May 24, 1977

[54] TELEVISION CAMERA TUBE HAVING CHANNELED PHOTOSENSITIVE TARGET SPACED FROM SIGNAL ELECTRODE

[75] Inventors: Paulus Philippus Maria Schampers; Marino Giuseppo Carasso; Arthur Marie Eugene Hoeberechts, all of Eindhoven, Netherlands

[73] Assignee: U.S. Philips Corporation, New York, N.Y.

[22] Filed: Sept. 10, 1975

[21] Appl. No.: 612,250

[30] Foreign Application Priority Data

Sept. 27, 1974 Netherlands ..... 7412756

[52] U.S. Cl. ..... 313/367; 313/386; 313/395; 313/105 CM

[51] Int. Cl.[2] ..... H01J 29/45; H01J 31/44; H01J 31/40

[58] Field of Search ..... 313/395, 384, 385, 386, 313/390, 374, 367

[56] References Cited

UNITED STATES PATENTS

| | | | |
|---|---|---|---|
| 2,572,497 | 10/1951 | Law | 313/374 X |
| 2,787,724 | 4/1957 | Webley | 313/395 X |
| 2,820,167 | 1/1958 | Schroeder | 313/384 |
| 3,649,866 | 3/1972 | Salgo | 315/11 |

*Primary Examiner*—Robert Segal
*Attorney, Agent, or Firm*—Frank R. Trifari; Carl P. Steinhauser

[57] ABSTRACT

A television camera tube having a discrete structure of photosensitive elements provided on an electrically conductive carrier covered entirely with photoconductive material or another resistance material, so that with a suitable potential applied to the carrier a potential distribution occurs having successive saddle points for the scanning beam. Variation and exposure of the discrete photoconductive elements then results in a variation in beam splitting in the saddle points, as a result of which the tube has a greater or smaller extent of natural amplification.

3 Claims, 3 Drawing Figures

TELEVISION CAMERA TUBE HAVING CHANNELED PHOTOSENSITIVE TARGET SPACED FROM SIGNAL ELECTRODE

The invention relates to a television camera tube having a target which is to be scanned by an electron beam and which comprises a transparent electrically conductive signal electrode and discrete structure of photosensitive elements provided on an electrically conductive carrier.

Such a camera tube is known from the U.S. Pat. No. 3,649,866, It is the object of the camera tube described in said Specification to provide a storage tube which, with a control suitable for that purpose, can store an image up to several days. In order to achieve this, an electrically conductive mesh structure is covered with photoconductive material on the side remote from the electron source. By local differences in exposure of said structure, a larger or smaller part of the scanning electron beam is passed to the signal electrode and hence a beam splitting introduced by the beam acceptance of the target occurs which is also influenced by the extent of exposure of the photoconductive structure. Because the electrically conductive mesh structure is left uncovered on the side facing the electron source, the operation of said tube will not be optimum.

It is the object of the invention to provide a television camera tube with which an adjustable natural amplification can be realised while using the beam acceptance of the target. To be considered, for example, is a natural amplification of a decade.

For that purpose, a television camera tube of the kind mentioned in the preamble is characterized according to the invention in that the structure of photosensitive elements is provided on an electrically conductive carrier, in which, except for the signal electrode, no electrically conductive material which is directly visible for the electron beam is added and with which, in cooperation with the signal electrode, a potential field is adjustable which, proceeding in the direction of movement of the scanning electron beam, shows at least two successive saddle points in which the scanning electron beam experience a local beam splitting which is a function of potentials to be applied externally and of local exposure of the target.

Since in a television camera tube according to the invention the inertia is adjustable by applying potentials suitable for that purpose, the tube may be used at will as a normal television camera tube having an inertia and sensitivity which is normal for that purpose or, by the natural amplification to be realized, as an extra sensitive tube having a comparatively large inertia. The latter is favourable for making television scenes in spaces where, for external reasons, a comparatively low light level is desired. The further operation and apparatus of a television camera having a camera tube according to the invention need not experience any drastic alterations in contrast with solutions having a separate image amplification.

The structure of photosensitive elements may be provided, for example, on an electrically conductive mesh grid arranged between the mesh electrode of the electron gun and the signal electrode. The photoconductive material is provided on the side of said grid facing the signal electrode. The remaining part of the grid wires is covered with a resistance material. The photosensitive structure may also be provided in a disk of semiconductive material which in the tube occupies a position corresponding to the said grid. The photosensitive structure may also be provided in the form of a line pattern or a mosaic of discrete elements on an electric conductor which is also discrete. Said conductor may be provided directly on the signal electrode, if desired with the addition of a separation layer, and that with such a structure that, when external potentials suitable for that purpose are applied, two saddle points occur in the potential field.

A few preferred embodiments according to the invention will now be described in greater detail with reference to the accompanying drawing, In the drawing.

Figure 1:
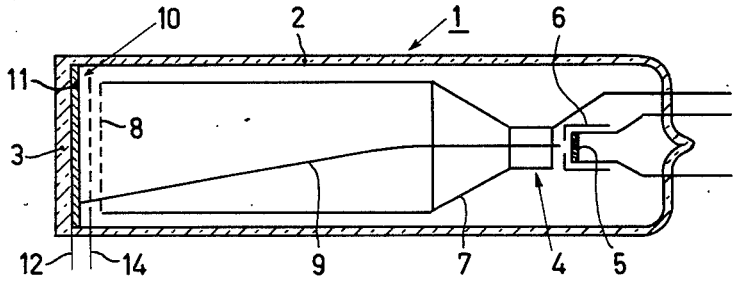
FIG. 1 shows diagrammatically a television camera tube according to the invention having a mesh grid which is provided with a photoconductor.
Figure 2:
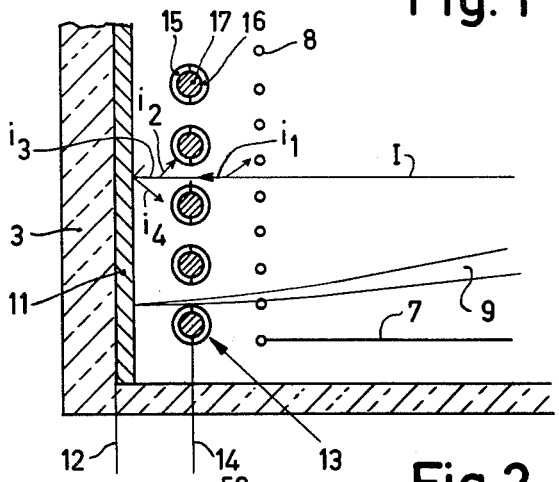
FIG. 2 shows a part of the television camera tube shown in FIG. 1 on an enlarged scale.

FIG. 1 is a diagrammatic sectional view of a television camera tube 1 of the vidicon type. Said camera tube comprises within a wall 2 having an input window 3 an electron gun 4 having a cathode 5, one or several control grids 6 and an output anode 7. At or near the end of the anode 7 remote from the electron gun a mesh electrode 8 is present with which a scanning electron beam 9 is directed in principle normal to a target 10. By means of electromagnetic coils (not shown) which are preferably arranged around the camera tube, or electrostatic electrodes which are preferably mounted in the camera tube, a scanning movement across the target is given to the electron beam and the beam is focused on the target. As is shown more clearly in FIG. 2, the target 10 in this preferred embodiment comprises a transparent signal electrode 11 which consists, for example, of a layer of electrically conductive tin oxide provided on the inner side of the input window and is led through electrically to the exterior of the tube wall via a conductor 12. An electrically conductive grid 13 having an electric leadthrough 14 is present between the signal electrode 11 and the mesh electrode 8. The grid 13 may be constructed from electrically conductive wires or from insulating wires 17, for example glass wires, covered with a conductive layer. On its side facing the signal electrode the grid 13 has a photoconductive material 15, for example, antimony trisulphide or lead monoxide, and has a resistance material 16 on its side facing the mesh electrode. The said photoconductive materials may be used as a resistance material, but known resistance materials, such as KCl, may also be used. All wires 17 of the grid 13 are collectively covered entirely by the two mentioned materials.

If the reistance layer on the grid has a strongly electrically insulating character, said layer will be stabilized at a certain negative voltage relative to the cathode by rapid electrons from the scanning beam. If the scanning beam represents a current strength I, then the beam is split into a part $i_1 = t\,\mathrm{I}$ where $t$ is the transmission of the grid 8, a current $i_2 = rt\mathrm{I}$, where $r$ is the fraction reflected by the signal plate, a current $i_3 = (1-r)t\mathrm{I}$ and a current $i_4 = S(1-r)t\mathrm{I}$, where $s$ the secondary emission coefficient of the signal plate. Via the electron beam I $a$ part $\mathrm{I}_r = (i_2 + i_4)$ consequently impinges on the grid 13 and a part $\mathrm{I}_s = (i_3 - i_4)$ impinges on the signal electrode. With the given values for the currents $i_1$ ,$i_2$ , $i_3$ and $i_4$ this results in a grid current $I_r = (s + r(1 - 5))tI$ and in a signal current $I_5 = (1 - s)(1 - r)tI$. The value of $t$ in a given tube is mainly determined by the surface potential of the photoconductor and will of course be larger as the potential of the photoconductor is higher. Below a certain potential, $t$ becomes equal to zero. The potential of the photoconductor $V_E$ will be stabilised at a potential $V_O$ by the scanning electron beam. By adjusting in this situation the base potential of the signal electrode $V_s$ at different values, different conditions will now occur of which the following are to be distinguished.

Condition A $V_S < O$, then $r$ becomes equal to 1 hence $I_r = tI$ and $I_S = 0$, the whole scanning beam is conveyed to the grid.

Condition B $O \leq V_S < v_F$, then the above-mentioned values apply for $I_r$ and $I_s$.

Condition C $V_F \leq V_S$, then $s$ becomes equal to 0 and hence $I_r = r\,t\,I$ and $I_S = (1-r)tI$.

Condition D $V_F \gg V_S$, then $r$ approaches the value zero and it will apply approximately that $I_r = 0$ and $I_s = tI$.

If now the current $I_r = i_2 + i_4$ is sufficient to stabilise a photo current $I_f$ occurring in the photoconductor, which cannot be achieved in condition D, then it holds that $I_r = I_f$. During normal operation of a television camera tube the signal current is also equal to $I_f$. If in the tube according to the invention $I_s + I_r$ is detected, then the internal amplification of the tube is given by $$g = \frac{Is + Ir}{IF} = 1 + \frac{Is}{Ir}.$$

In the above-mentioned three condition we see successively condition A with $g = 1$, so no amplification In condition B with $$g = \frac{1}{s + r(1 - s)} \text{ or } g = 1 + \frac{1 - r}{r + \frac{s}{1 - s}}$$

and in condition C with $g = 1/r$ or $g = 1 - 1 - r/r$, internal amplification occurs in which, since $r \leq 1$ it always holds that $g \geq 1$.

If the grid 13 on the gun side is not provided with an insulating material, but with a resistance material having a certain electric conductivity, for example, a photoconductor material, a corresponding pattern will occur. An advantage is that any accidental charge of grid at that area disappears more rapidly, a drawback is that to the current to be detected a constant extra current is added which is to be supplied by the electron gun. In the known tube mentioned in the preamble this drawback is present to a very strong extend since the electron beam can be captured directly by conductive grid material. As a result of this the desired effect will hardly occur or will not occur at all in said tubes.

In a television camera tube having, for example, a discrete pattern of photoconductive elements which, together with an electrically conductive carrier, are provided on the signal electrode, an internal amplification can be obtained in a corresponding manner. In this case also the configuration of the target should be such that again two saddle points occur in the local potential distribution so that the acceptance of the target can be controlled as a function of a local exposure and of potentials to be applied.

Figure 3:
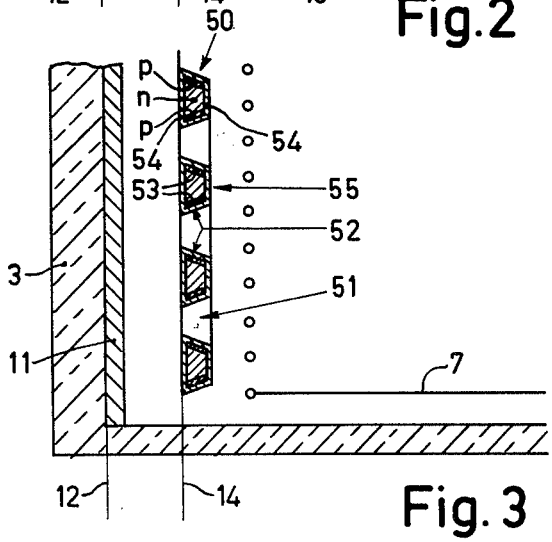
FIG. 3 shows a target for a television camera tube according to the invention having a discrete structure of photosensitive elements arranged in a disk of semiconductor material.

FIG. 3 shows a preferred embodiment according to the invention in which the target comprises a disk of semiconductor material 50, for example of silicon. The disk has a matrix of perforations 51. The boundaries 52 of the perforations 51 are given a conductivity type opposite to that of the disk material, for example by diffusion, for example p-type conductivity for the wall material and n-type conductivity for the disk material. Between the p-conductive wall 53 and the n-conductive body a depletion layer is formed so that a photodiode is formed. The passage of electrons from the scanning electron beam can also be controlled by the potential of the disk since in this case also successive saddle points occur in the potential distribution. Local passage differences occur by locally different exposure of the semiconductor material. The base material, so in this case the n-type conductive material, is covered with, for example, an insulating layer 54 on which a resistance layer (not shown) may be provided at least on the surface facing the gun side. Said layer may continue throughout the surface including the p-conductive walls. A television camera tube having such a disk and placed at some distance from the signal electrode can be given a natural amplification by suitable choice of the potential of the signal electrode 11 which in this case also is based on the acceptance to a greater or smaller extent of the scanning electron beam. Upon forming the silicon disk it is favourable to start from a 100 orientation of the material. Since upon etching conical perforations are formed, a potential field which is favourable for the beam splitting adjusts as a result of a comparatively favourable position of the saddle points necessary for that purpose. Such an orientation is also in favour of the image quality.

As is the case when using a discrete structure of a photoconductive material in which said material may be provided both on a separate grid and on the signal electrode, the discrete structure of p-n junctions may also be provided directly on the signal electrode. To be considered is a mosaic of, for example, annular regions provided on a side of a disk of semiconductor material facing the electron gun. By means of the structure of said regions, a potential field can be realized in which the incident beam of electrons experiences a beam splitting which can be influenced by the potential of the signal electrode.

What is claimed is:

1. A television camera tube comprising an electron beam source and a target which is to be scanned by the electron beam and which comprises a transparent electrically conductive signal electrode and a discrete structure of photo sensitive elements provided on an electron beam pervious electrically conductive carrier spaced from the signal electrode, each of said photosensitive elements having a portion exposed to the electron beam which has a conductivity substantially less than that of said carrier, said structure of discrete photosensitive elements being a matrix of channels provided in a disk of semiconductor material, of which channels the side walls have a conductivity type opposite to that of the disk material, the remaining disk material being covered with a resistance layer, said structure, in cooperation with the signal electrode, defining a potential field which is adjustable and which, proceeding in the direction of movement of the scanning electron beam, shows at least two successive saddle points in which the scanning electron beam experiences a local beam splitting which is a function of potentials to be applied and of local exposure of the target.

2. A television camera tube as claimed in claim 1, wherein the channels in the disk of semiconductor material have a conical narrowing towards the signal electrode.

3. A television camera tube as claimed in claim 1 wherein the perforated disk of semiconductor material is provided directly on the signal electrode.

* * * * *

UNITED STATES PATENT AND TRADEMARK OFFICE

CERTIFICATE OF CORRECTION

PATENT NO. : 4,025,814

DATED : May 24, 1977

INVENTOR(S) : PAULUS P.M. SCHAMPERS ET AL

It is certified that error appears in the above-identified patent and that said Letters Patent are hereby corrected as shown below:

Column 3, line 1, change "(1 - 5)" to read --(1 - s)--;

Column 3, line 2, change "$I_5$" to read --$I_s$--;

Column 3, line 41, change "g = 1 - 1 - r/r" to read $$--g = 1 + \frac{1 - r}{r}--;$$

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*